US010612266B2

(12) United States Patent
Siebenaler

(10) Patent No.: US 10,612,266 B2
(45) Date of Patent: Apr. 7, 2020

(54) CAMPING SYSTEM AND METHOD FOR SUSPENDING A HAMMOCK INSIDE A CAMPING TENT

(71) Applicant: Christopher Paul Siebenaler, Minneapolis, MN (US)

(72) Inventor: Christopher Paul Siebenaler, Minneapolis, MN (US)

( * ) Notice: Subject to any disclaimer, the term of this patent is extended or adjusted under 35 U.S.C. 154(b) by 0 days.

(21) Appl. No.: 15/956,453

(22) Filed: Apr. 18, 2018

(65) Prior Publication Data

US 2018/0305950 A1 Oct. 25, 2018

Related U.S. Application Data

(60) Provisional application No. 62/487,060, filed on Apr. 19, 2017.

(51) Int. Cl.

| | |
|---|---|
| ***E04H 15/02*** | (2006.01) |
| ***A45F 3/22*** | (2006.01) |
| ***E04H 15/04*** | (2006.01) |
| ***E04H 15/30*** | (2006.01) |

(52) U.S. Cl.

CPC ..... *E04H 15/02* (2013.01); *A45F 3/22* (2013.01); *E04H 15/04* (2013.01); *E04H 15/30* (2013.01)

(58) Field of Classification Search

CPC ..... E04H 15/02; E04H 15/04; E04H 15/18; E04H 15/42; E04H 15/30; E04H 15/36; A45F 3/22; A45F 3/52; A45F 4/04

USPC ..... 135/90, 95–96, 124, 136–138, 156, 115, 135/120.1–120.2; 5/120–121, 127–130

See application file for complete search history.

(56) References Cited

U.S. PATENT DOCUMENTS

| | | | | |
|---|---|---|---|---|
| 594,598 | A | 11/1897 | Byxbe | |
| 1,156,200 | A | 10/1915 | Ashworth | |
| 1,343,800 | A | 6/1920 | Trimm | |
| 2,375,792 | A * | 5/1945 | Kearny | A45F 3/22 5/121 |
| 3,800,468 | A * | 4/1974 | de Graff | A01G 13/0231 135/115 |
| 4,001,902 | A * | 1/1977 | Hall | A45F 3/22 5/121 |
| 4,731,627 | A * | 3/1988 | Chisholm | G03D 17/00 135/87 |
| D403,041 | S | 12/1998 | Funk | |
| 5,913,772 | A * | 6/1999 | Clark | E04H 15/04 5/121 |
| 6,347,638 | B1 * | 2/2002 | Scott | E04H 15/04 135/115 |

(Continued)

FOREIGN PATENT DOCUMENTS

WO WO 2005067510 A2 7/2005

*Primary Examiner* — Winnie Yip
(74) *Attorney, Agent, or Firm* — Merchant & Gould P.C.

(57) ABSTRACT

A camping tent includes a tent body, and tent poles that erect the tent body into a structure having at least a base, sidewalls, and a roof. At least one of the sidewalls includes an opening to allow passage into and out of the structure, and a door that seals the opening. Protective flaps are located on opposing sidewalls of the structure, and are moveable from a closed position to an open position. A sleeve is attached to each protective flap. The sleeves define apertures adapted to receive opposing ends of a hammock allowing the opposing ends of the hammock to be attached to a support system located outside the camping tent.

22 Claims, 8 Drawing Sheets

(56) References Cited

U.S. PATENT DOCUMENTS

| | | | | |
|---|---|---|---|---|
| 7,699,068 | B2 | 4/2010 | Helsdon | |
| 7,789,098 | B2 * | 9/2010 | Livacich | E04H 15/001 135/115 |
| 8,936,034 | B2 * | 1/2015 | Rhett, Jr. | E04H 15/34 135/90 |
| 9,072,367 | B2 | 7/2015 | Kramer | |
| 9,260,881 | B2 * | 2/2016 | Lamke | E04H 15/36 |
| 9,314,090 | B1 | 4/2016 | Manning | |
| 9,359,786 | B1 | 6/2016 | Fenton | |
| 9,788,639 | B2 * | 10/2017 | Frazer | A45F 3/22 |
| 2003/0178055 | A1 * | 9/2003 | Laakso | E04H 15/425 135/119 |
| 2008/0105290 | A1 * | 5/2008 | Ahn | E04H 15/003 135/124 |
| 2013/0276846 | A1 * | 10/2013 | Courtney | E04H 15/56 135/121 |

* cited by examiner

CAMPING SYSTEM AND METHOD FOR SUSPENDING A HAMMOCK INSIDE A CAMPING TENT

CROSS-REFERENCE TO RELATED APPLICATIONS

This application claims priority to U.S. Provisional Patent Application No. 62/487,060 filed Apr. 19, 2017, the disclosure of which is hereby incorporated by reference in its entirety.

TECHNICAL FIELD

The present disclosure relates generally to a camping system and method. More specifically, the present disclosure relates to a camping system and method that allow a hammock to be suspended inside a camping tent.

BACKGROUND

Camping is an outdoor recreational activity which involves staying out in the wilderness. Shelters are typically needed for sleeping which protect campers from outdoor elements such as rain, wind, and insects. Though some people may use a caravan or motorhome as a shelter, the most common form of shelter is a tent. A tent is used due to its affordability and compact size.

Tents have widespread use ranging from military to disaster situations. Tents were traditionally used by nomadic people all over the world, such as Native Americans, Mongolians, Tibetan and Turkic Nomads, and the Bedouin. Not only can tents be used for camping and temporary shelter for a few people, but may also be made large enough to house hundreds of people for events such as temporary military gatherings, parties, and weddings.

Due to the widespread use of tents during camping, there is a need to add additional features to existing camping tents to make the hobby more comfortable and to allow more freedom in how a person goes camping. Therefore, improvements are needed.

SUMMARY

In one aspect of the present disclosure a camping tent is disclosed. The camping tent includes a tent body, and tent poles adapted to erect the tent body into a structure having at least a base, sidewalls, and a roof. An opening is included on at least one of the sidewalls to allow passage into and out of the structure, and a door seals the opening. Protective flaps on opposing sidewalls of the structure are moveable from a closed position to an open position. A sleeve is attached to each protective flap. The sleeves define apertures adapted to receive opposing ends of a hammock, and allow the opposing ends of the hammock to be attached to a support system located outside the camping tent. In some examples, the camping tent includes a rainfly removably attachable to the roof, the rainfly fitting around the opposing ends of the hammock.

In another aspect of the present disclosure a method of assembling a camping tent is disclosed. The method includes using tent poles to erect a tent body into a structure having a base, sidewalls, and a roof, an opening on at least one of the sidewalls to allow passage into and out of the structure, and a door that seals the opening; moving protective flaps on opposing sidewalls of the structure from a closed position to an open position exposing an aperture inside a sleeve attached to each protective flap; inserting opposing ends of a hammock through the apertures of the sleeves; tying the opposing ends of the hammock to a support system located outside the structure for suspending the hammock inside the structure; and tightening a cinch around each sleeve for sealing the aperture of each sleeve. The method may also include attaching a rainfly to the structure, the rainfly fitting around the opposing ends of the hammock.

In another aspect of the present disclosure a camping system is disclosed. The camping system includes a camping tent having a tent body; tent poles that erect the tent body into a structure having at least a base, sidewalls, and a roof; an opening on at least one of the sidewalls to allow passage into and out of the structure, and a door that seals the opening. Protective flaps on opposing sidewalls of the structure are moveable from a closed position to an open position. A sleeve is attached to each protective flap, the sleeves defining apertures. The system also includes a hammock suspendable inside the camping tent, the hammock having a central support structure, and ropes attached to opposing ends of the central support structure. Each rope is extendible through each sleeve of the camping tent, and is attachable to a support system located outside the camping tent. In some examples, the camping system includes a rainfly removably attachable to the roof, the rainfly fitting around the ropes of the hammock.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
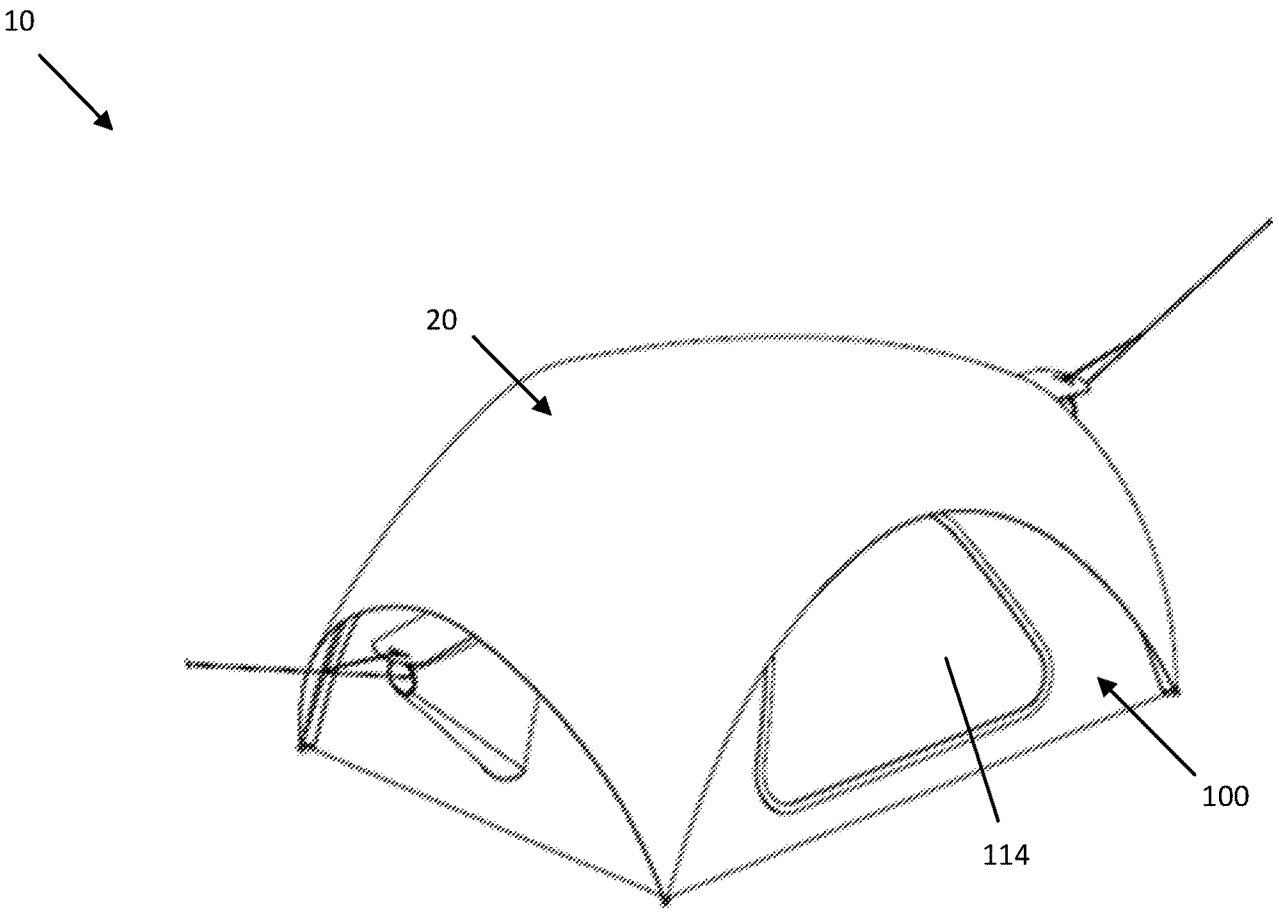
FIG. 1 is an isometric view of a camping system in accordance with certain examples of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of a camping system 10 in accordance with certain examples of the present disclosure. As shown in FIG. 1, the camping system 10 includes a camping tent 100 that allows a hammock to be suspended inside the camping tent 100. The camping system 10 also includes a rainfly 20 removably attachable to the camping tent 100. The rainfly 20 is a waterproof outer layer that can provide rain and wind protection to the camping tent 100.

Figure 2:
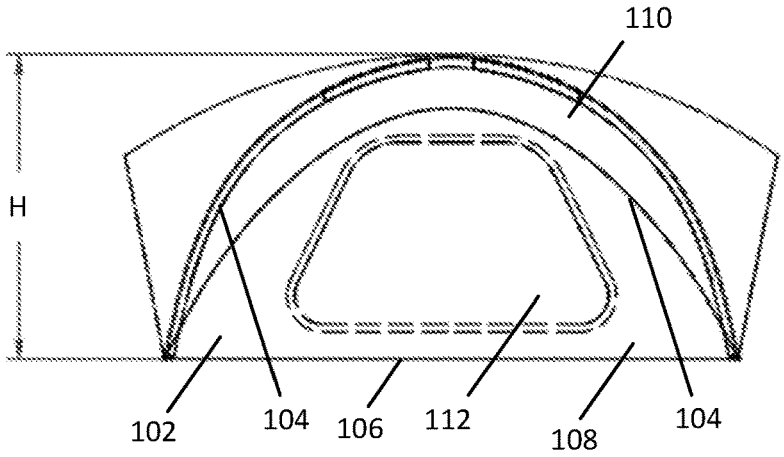
FIG. 2 is a front view of a camping tent in accordance with certain examples of the present disclosure.
Figure 3:
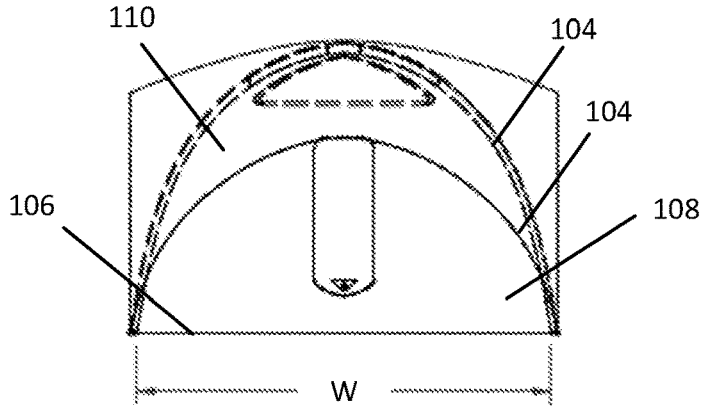
FIG. 3 is a right side view of the camping tent of FIG. 2, the left side view of the tent is substantially the same as the right side.
Figure 4:
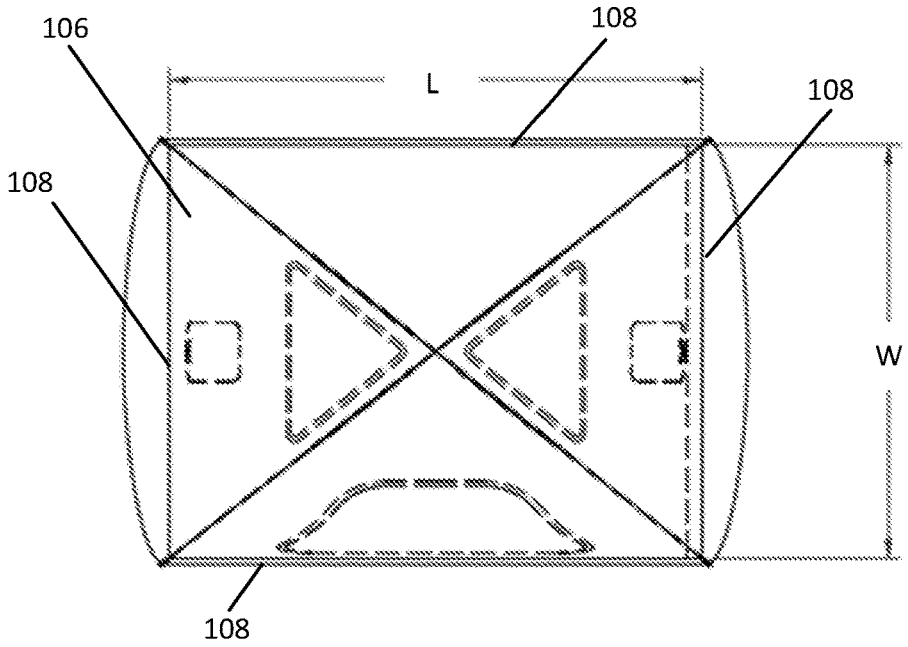
FIG. 4 is a bottom view of the camping tent of FIG. 1.

FIGS. 2, 3, and 4 illustrate front, side, and bottom views, respectfully, of the camping tent 100. As shown in these figures, the camping tent 100 includes a tent body 102 supported by a plurality of tent poles 104. The tent body 102 can be made from a fabric material such as nylon, polyester, laminates, canvas, and the like. The plurality of tent poles 104 can be made from a sturdy material such as aluminum, fiberglass, plastic, and the like.

The tent body 102 includes attachment mechanisms into which the tent poles can be inserted for erecting a tent structure having at least a base 106, sidewalls 108, and a roof 110. In some examples, the attachment mechanisms of the tent body 102 are embedded sleeves which the tent poles 104 can slide into. In other examples, the attachment mechanisms of the tent body 102 are collars that can be threaded by the tent poles 104.

The tent body 102 includes an opening 112 on at least one of the sidewalls. The opening 112 allows passage into and out of the structure of the camping tent 100. In some examples, the camping tent 100 can include a door 114 (shown in FIG. 1) that can seal the opening 112. In some examples, the door 114 is connected to the opening 112 of the tent body 102 by a zipper, and the opening 112 can be opened and closed by zipping and unzipping the door 114.

As shown in FIGS. 2, 3, and 4, the tent body 102 has a height H, a width W, and a length L when erected by the tent poles 104. In some examples, the height H can be in a range from 4 to 6 feet. In some examples, the width W can be in a range from 6 to 8 feet. In some examples, the length L can be in a range from 8 to 10 feet.

Figure 5:
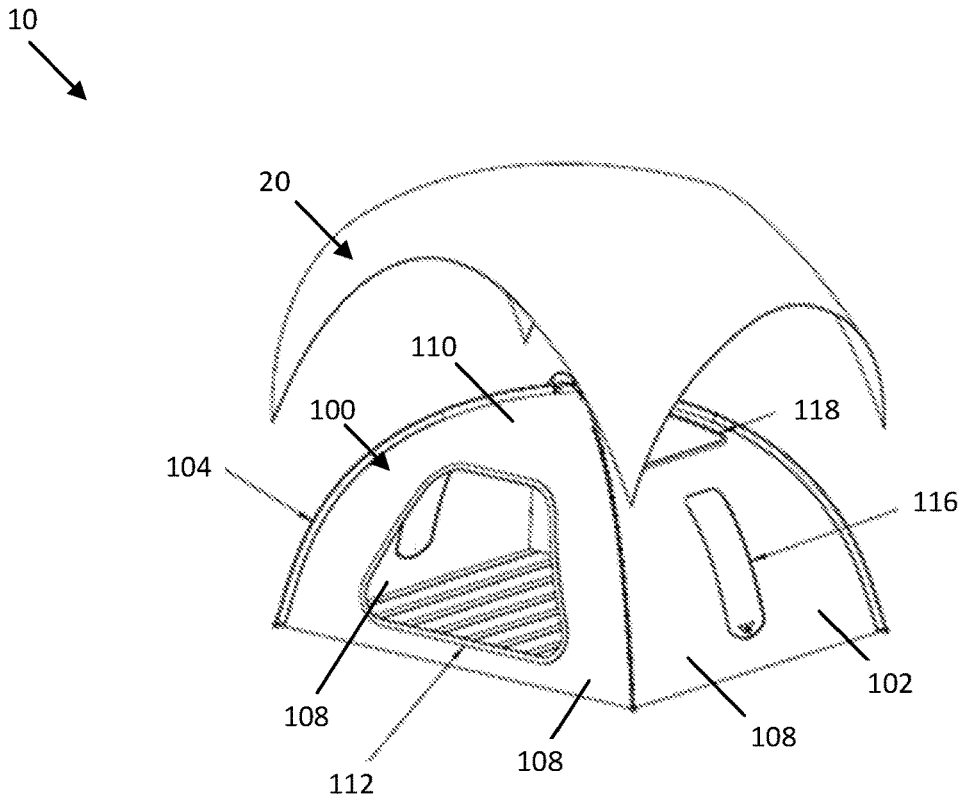
FIG. 5 is an isometric view of a camping tent with a rainfly removed.
Figure 6:
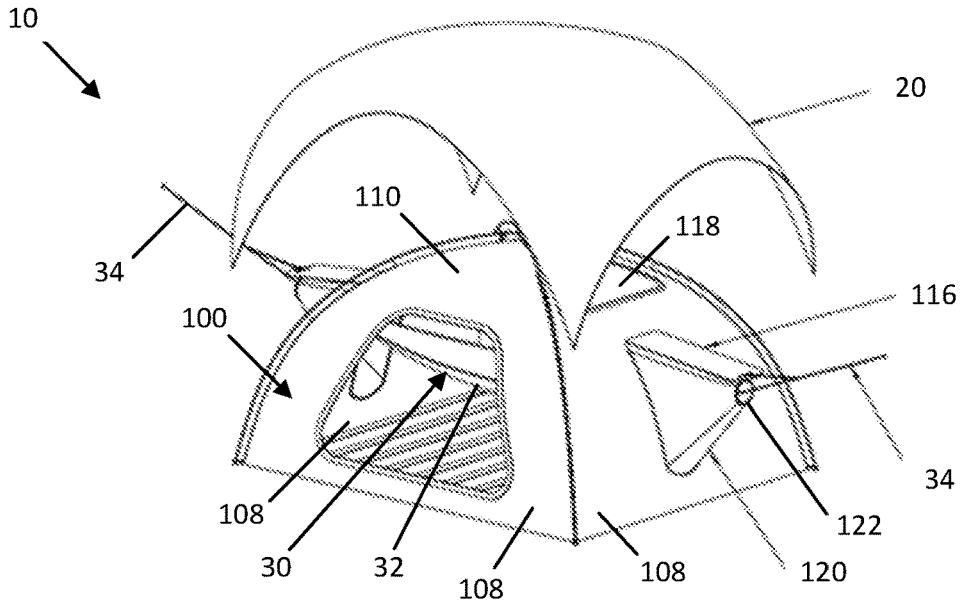
FIG. 6 is an isometric view of a camping tent with a rainfly removed, and a hammock suspended inside the tent.

FIG. 5 is an isometric view of the camping system 10 showing the rainfly 20 removed from the camping tent 100. FIG. 6 is another isometric view of the camping system 10 with the rainfly 20 removed from the camping tent 100, and a hammock 30 suspended inside the camping tent 100. As shown in these figures, the tent body 102 includes protective flaps 116 on opposing sidewalls 108. The protective flaps 116 are moveable from a closed position to an open position. A sleeve 120 is attached to each protective flap 116. Each sleeve 120 defines an aperture 122.

As shown in FIG. 6, a hammock 30 is suspendable inside the camping tent 100. The hammock 30 includes a central support structure 32, and ropes 34 attached to opposing ends of the central support structure 32. The central support structure 32 can be made from a fabric panel, or a woven network of twine or thin rope. The central support structure 32 can support the weight of a camper who can sleep or rest on the hammock 30 inside the camping tent 100. Thus, a camper can enjoy the comfort of the hammock 30 while being protected from the outside elements as a result of the protection provided by the camping tent 100 and rainfly 20.

Each rope 34 of the hammock 30 is extendible through each sleeve 120 of the camping tent 100 so that each rope 34 can extend from the inside of the camping tent 100 to the outside of the aperture 122 of each sleeve 120. The ropes 34 can be attached to a support system to suspend the hammock 30 inside the camping tent 100. In some examples, the support system can include poles that have been secured to the ground outside of the camping tent 100. In other examples, the support system can includes trees located outside of the camping tent 100.

As shown in FIGS. 5 and 6, in some examples the camping tent 100 includes window 118 on the roof 110. In some examples, the window 118 is made from a mesh material. The window 118 can provide ventilation for the inside of the camping tent 100.

Figure 7:
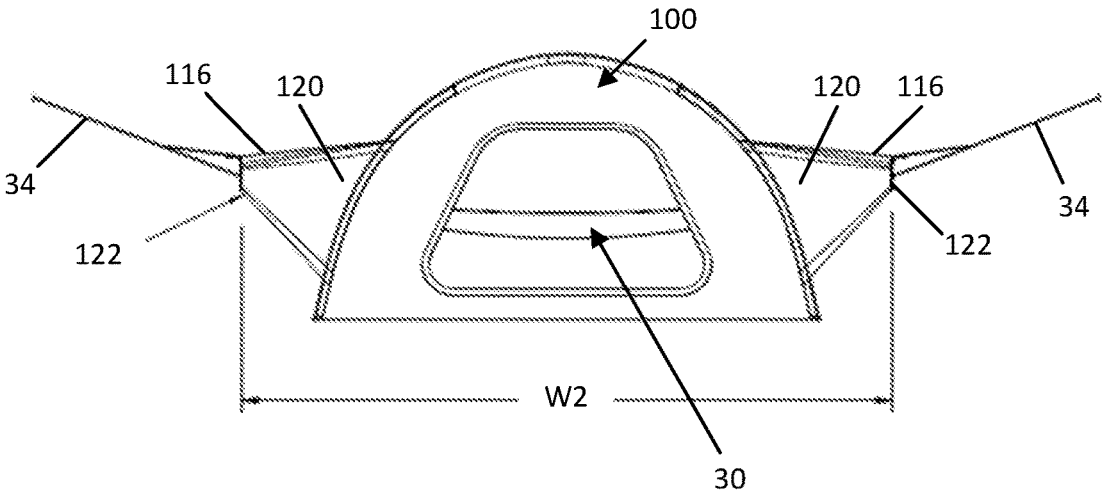
FIG. 7 is a front view of a camping tent with a rainfly removed, and a hammock suspended inside the tent.

FIG. 7 is a front view of the camping tent 100 with the rainfly 20 removed, and the hammock 30 suspended inside the camping tent 100. When the protective flaps 116 are in the open position, the sleeves 120 extend a distance from the opposing sidewalls 108 of the camping tent 100. This gives the camping tent 100 a total width W2. In some examples, the total width W2 of the camping tent 100 is in a range from 10 to 14 feet long.

Figure 8:
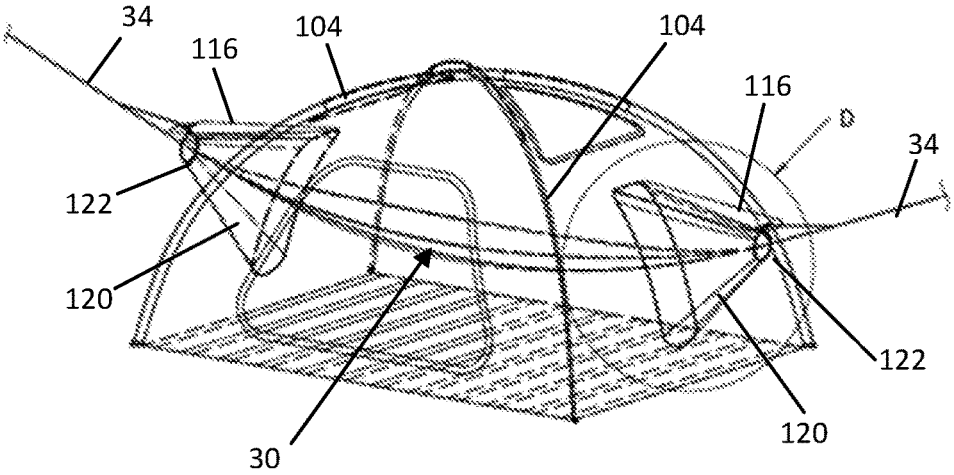
FIG. 8 is a see-through isometric view of the camping tent of FIG. 7.
Figure 9:
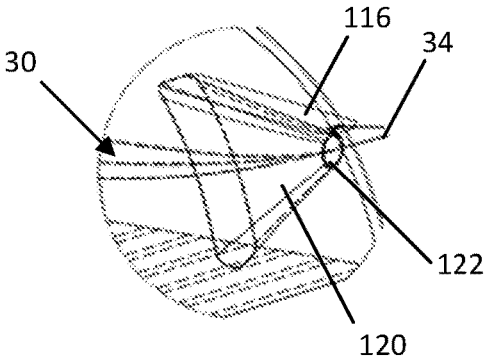
FIG. 9 is a detailed view of the camping tent of FIG. 8.

FIG. 8 is a see-through isometric view of the camping tent of FIG. 7. FIG. 9 is a detailed view of the camping tent of FIG. 8. As shown in these figures, the ropes 34 of the hammock 30 can be inserted through the sleeves 120 and outside the apertures 122. The ropes 34 can be attached to a support system for suspending the hammock inside the camping tent 100. FIG. 9 also shows the tent poles 104 which are used for erecting the tent body 102.

Figure 10:
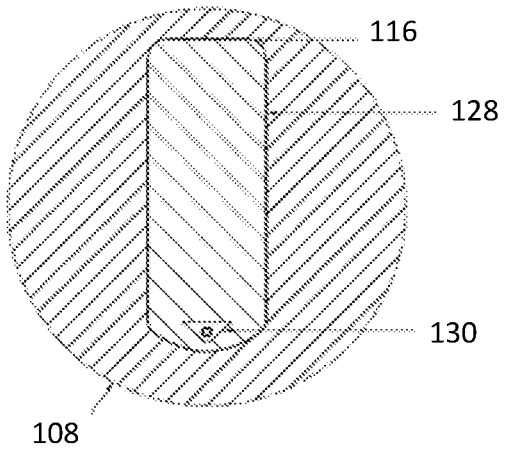
FIG. 10 is a detailed view of a protective flap in a closed positioned.

FIG. 10 is a detailed view of a protective flap 116 in a closed positioned. As shown in FIG. 10, the protective flap 116 includes a holding point 130. As will be described in more detail, the holding point 130 can be used to secure the protective flap 116 to one of the ropes of the hammock when the protective flap 116 is in the open position.

Still referring to FIG. 10, the protective flap 116 is surrounded by a zipper 128. The zipper 128 can secure the protective flap 116 to a sidewall 108 of camping tent when the protective flap 116 is in the closed position. Thus, when in the closed position, the protective flap 116 can be secured to the camping tent during strong gusts of wind and other severe weather.

Figure 11:
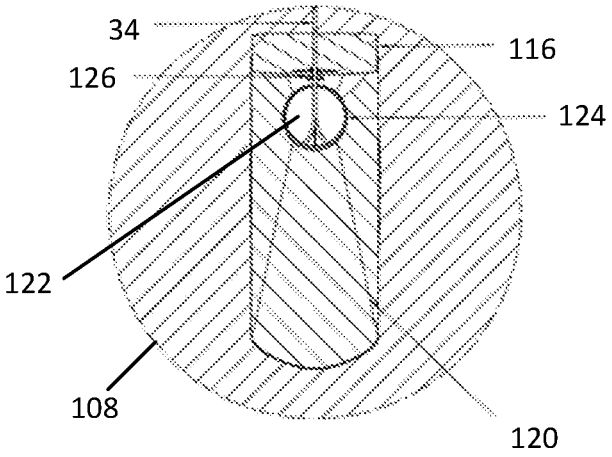
FIG. 11 is a detailed view of a protective flap in an open position.

FIG. 11 is a detailed view of a protective flap 116 in an open position. As shown in FIG. 11, the protective flap 116 is attached to the sleeve 120 via a locking device 126. Thus, when the protective flap 116 is moved from the closed position to the open position, the sleeve 120 is extended into an open position that exposes the aperture 122. In some examples, the locking device 126 is a loop that connects the protective flap 116 to the sleeve 120.

Still referring to FIG. 11, the sleeve 120 also includes a cinch 124. As will be described in more detail, the cinch 124 can be tightened for closing the aperture 122.

Figure 12:
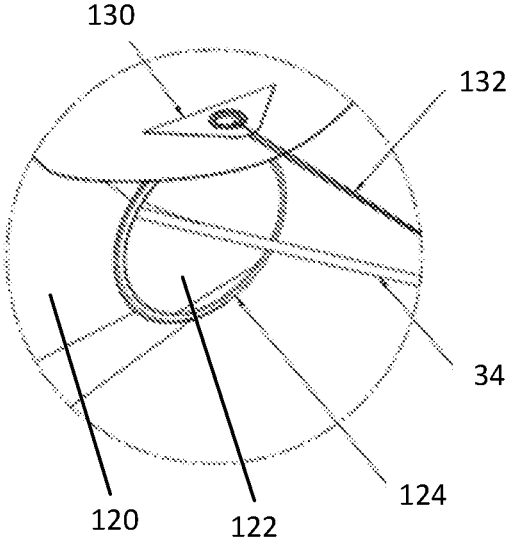
FIG. 12 is a detailed isometric view of a protective flap in an open position, and a cinch in a loosened state.

FIG. 12 is a detailed isometric view of a protective flap 116 in an open position, and a cinch 124 in a loosened state. As shown in FIG. 12, the cinch 124 surrounds the aperture 122, and allows a rope 34 of the hammock to pass through the aperture 122.

Figure 14:
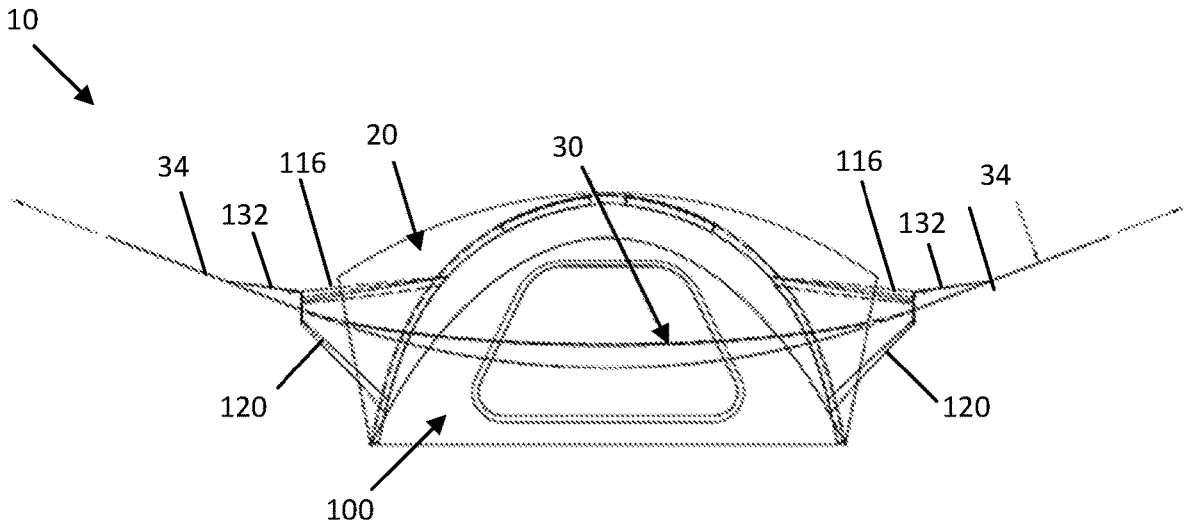
FIG. 14 is a front view of a camping system that includes a camping tent, a rainfly, and a hammock suspended inside the camping tent.
Figure 15:
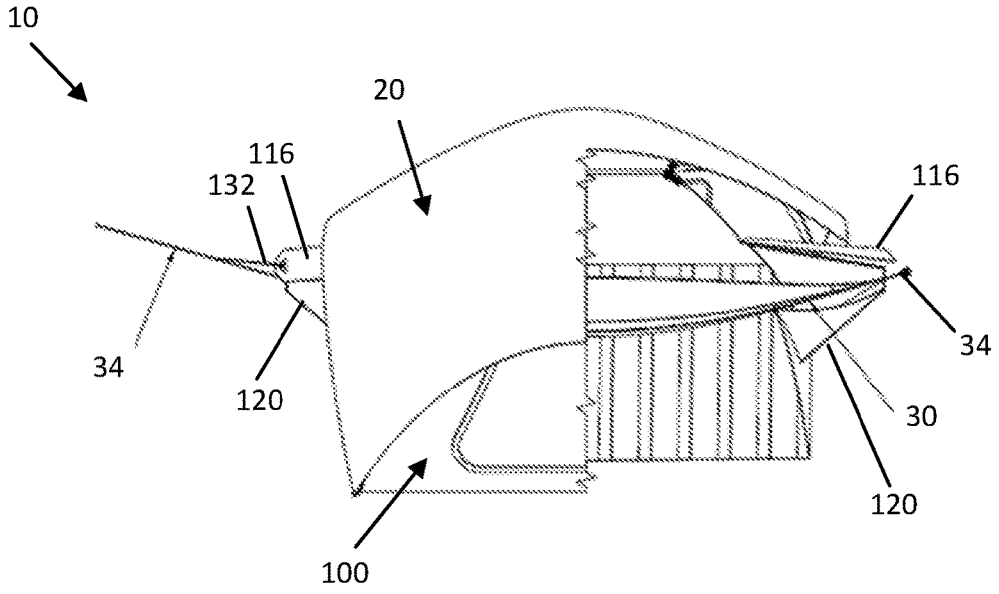
FIG. 15 is a partial cut-away view of the camping system of FIG. 14.

FIG. 12 also shows a flap tension rope 132 that threads through the holding point 130 to attach the protective flap 116 to the rope 34 of the hammock (as also shown in FIGS. 14 and 15). Thus, the protective flap 116 can be attached to the rope 34 of the hammock when the protective flap 116 is in the open position. This feature can secure and stabilize the protective flap 116 against strong gusts of wind and other severe weather.

Figure 13:
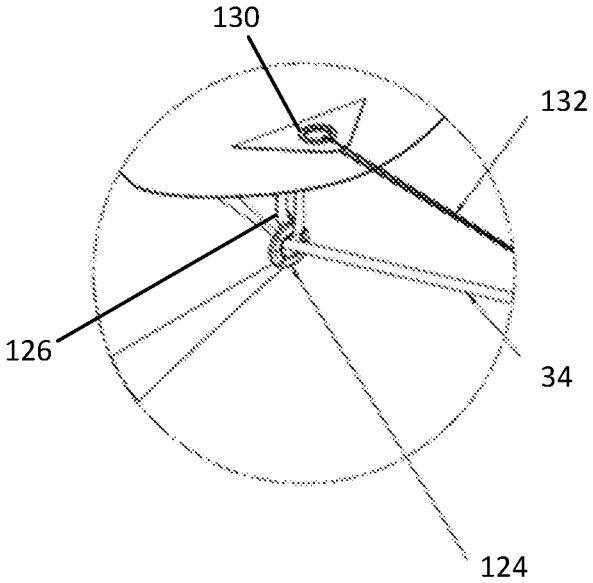
FIG. 13 is a detailed isometric view of a protective flap in an open position, and a cinch in a tightened state.

FIG. 13 is a detailed isometric view of a protective flap 116 in an open position, and a cinch 124 in a tightened state. As shown in FIG. 13, the cinch 124 can be tightened for sealing the aperture 122 after the rope 34 of the hammock is passed through the aperture 122. Thus, the cinch 124 can be used to environmentally seal the camping tent when the hammock is suspended inside the camping tent so that insects, water, humidity etc. do not enter the camping tent.

FIG. 13 also shows the locking device 126 in more detail. As described above, the locking device 126 can be used to secure the sleeve 120 to the protective flap 116. As shown in FIG. 13, the locking device 126 is looped underneath the cinch 124.

FIG. 14 is a front view of the camping system 10 that includes the camping tent 100, the rainfly 20, and the hammock 30 suspended inside the camping tent 100. FIG. 15 is a partial cut-away view of the camping system of FIG. 14. As shown in these figures, when the rainfly 20 is attached to the camping tent 100, the rainfly is shaped to avoid interfering with the ropes 34 of the hammock 30. Thus, the rainfly 20 can be attached to the camping tent 100 while the hammock 30 is suspended inside the camping tent 100.

Figure 16:
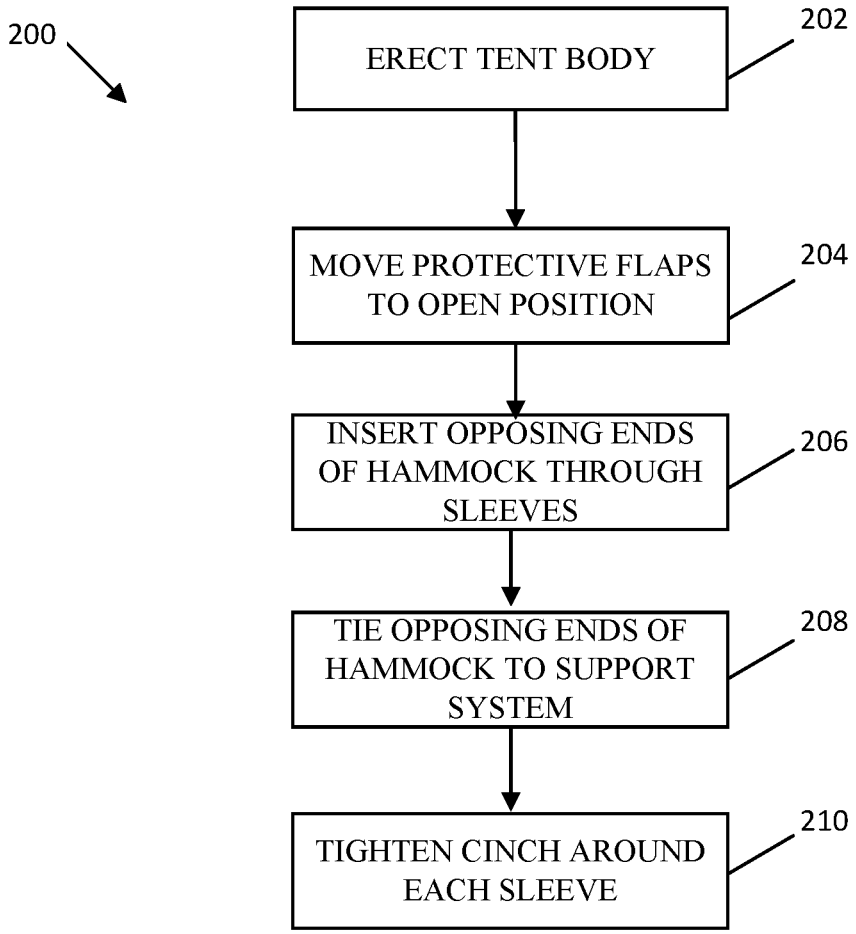
FIG. 16 is a block diagram illustrating a method of assembling a camping tent.

FIG. 16 is a block diagram illustrating a method 200 of assembling a camping tent. The method 200 includes a step 202 of using tent poles to erect a tent body into a structure. The structure includes a base, sidewalls, and a roof, and an opening on at least one of the sidewalls to allow passage into and out of the structure, and a door that seals the opening.

Next, the method 200 includes a step 204 of moving protective flaps on opposing sidewalls of the structure from a closed position to an open position. When in the open position, an aperture inside a sleeve attached to each protective flap is exposed. In some examples, moving the protective flaps from the closed position to the open position includes unzipping a zipper positioned around each protective flap.

Thereafter, the method 200 includes a step 206 of inserting opposing ends of a hammock through the apertures of the sleeves.

Next, the method 200 includes a step 208 of tying the opposing ends of the hammock to a support system located outside the structure for suspending the hammock inside the structure.

In some examples, tying the opposing ends of the hammock to the support system includes securing a pair of poles to the ground outside the structure of the camping tent, and tying the opposing ends of the hammock to the pair of poles. In other examples, tying the opposing ends of the hammock to the support system includes tying the opposing ends of the hammock to a pair of trees located outside the structure of the camping tent.

In some examples, after tying the opposing ends of the hammock to the support system, the method 200 includes a step of tying the protective flaps to opposing ends of the hammock. In some examples, a flap tension rope is used to tie the protective flaps to the opposing ends of the hammock for securing the protective flaps to the opposing ends of the hammock.

Thereafter, the method 200 includes a step 210 of tightening a cinch around each sleeve for sealing the aperture of each sleeve.

In some examples, the method 200 includes a step of attaching a rainfly to the structure. The rainfly is shaped for fitting around the opposing ends of the hammock.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A camping tent comprising:

a tent body;

tent poles adapted to erect the tent body into a structure having at least a base, sidewalls, and a roof;

an opening on at least one of the sidewalls to allow passage into and out of the structure, and a door that seals the opening;

protective flaps on opposing sidewalls of the structure, the protective flaps moveable from a closed position to an open position;

a sleeve attached to each protective flap, the sleeves defining apertures adapted to receive opposing ends of a hammock and allow the opposing ends of the hammock to be attached to a support system located outside the camping tent; and locking devices that attach the sleeves to the protective flaps such that when the protective flaps are moved from the closed position to the open position, the sleeves are extended into the open position for exposing the apertures.

2. The camping tent of claim 1, further comprising a rainfly removably attachable to the roof, the rainfly being structured to fit around the opposing ends of the hammock.

3. The camping tent of claim 1, further comprising a cinch on each sleeve, the cinches seal the apertures of the sleeves of the camping tent when the opposing ends of the hammock are extended through the sleeves.

4. The camping tent of claim 3, wherein the camping tent is environmentally sealed when the apertures on the sleeves are sealed by the cinches, and the opening on at least one of the sidewalls is sealed by the door.

5. The camping tent of claim 1, further comprising zippers positioned around each protective flap for securing each protective flap to a sidewall of the structure.

6. The camping tent of claim 1, further comprising a hammock suspended inside the structure of the camping tent.

7. The camping tent of claim 1, further comprising a mesh window on the roof.

8. The camping tent of claim 1, wherein the tent body is made from a fabric material including nylon, polyester, laminates, and canvas.

9. The camping tent of claim 1, wherein each locking device is a loop that connects the protective flap to the sleeve.

10. The camping tent of claim 1, further comprising a cinch on each sleeve, the cinches being structured to seal the apertures of the sleeves around the opposing ends of the hammock when the opposing ends are extended through the sleeves; and wherein the locking devices are looped underneath each cinch.

11. The camping tent of claim 1, further comprising a holding point on each protective flap, the holding points being structured to secure each protective flap to an opposing end of the hammock when the protective flaps are in the open position.

12. The camping tent of claim 11, further comprising flap tension ropes each threaded through the holding points to attach the protective flaps to the opposing ends of the hammock.

13. A method of assembling a camping tent, the method comprising:

using tent poles to erect a tent body into a structure having a base, sidewalls, and a roof, and an opening on at least one of the sidewalls to allow passage into and out of the structure, and a door that seals the opening, and the structure further including protective flaps and corresponding sleeves on opposing sidewalls, each sleeve defining an aperture;

attaching the protective flaps to the sleeves using locking devices;

moving the protective flaps on the opposing sidewalls of the structure from a closed position to an open position for exposing the aperture inside each sleeve attached to each protective flap;

inserting opposing ends of a hammock through the apertures of the sleeves;

tying the opposing ends of the hammock to a support system located outside the structure for suspending the hammock inside the structure; and tightening a cinch around each sleeve for sealing the aperture of each sleeve.

14. The method of claim 13, further comprising attaching a rainfly to the structure, the rainfly fitting around the opposing ends of the hammock.

15. The method of claim 13, wherein moving the protective flaps on the opposing sidewalls of the structure from the closed position to the open position includes unzipping a zipper positioned around each protective flap.

16. The method of claim 13, wherein after tying the opposing ends of the hammock to the support system, the method further comprises tying the protective flaps to the opposing ends of the hammock.

17. The method of claim 13, wherein tying the opposing ends of the hammock to the support system includes securing a pair of poles to the ground outside the structure of the camping tent, and tying the opposing ends of the hammock to the pair of poles.

18. The method of claim 13, wherein tying the opposing ends of the hammock to the support system includes tying the opposing ends of the hammock to a pair of trees located outside the structure of the camping tent.

19. A camping system comprising:

a camping tent including:

a tent body;

tent poles that erect the tent body into a structure having at least a base, sidewalls, and a roof;

an opening on at least one of the sidewalls to allow passage into and out of the structure, and a door that seals the opening;

protective flaps on opposing sidewalls of the structure, the protective flaps moveable from a closed position to an open position; and a sleeve attached to each protective flap by a locking device such that when the protective flaps are moved from the closed position to the open position, the sleeves are extended into the open position for exposing an aperture defined by each sleeve; and a hammock suspendable inside the camping tent, the hammock including:

a central support structure, and ropes attached to opposing ends of the central support structure, each rope is extendible through each sleeve of the camping tent, and is attachable to a support system located outside the camping tent.

20. The camping system of claim 19, further comprising a rainfly removably attachable to the roof, the rainfly fitting around the ropes of the hammock.

21. The camping system of claim 19, further comprising a cinch on each sleeve, the cinches seal the apertures of the sleeves of the camping tent when the ropes of the hammock are extended through the sleeves.

22. The camping system of claim 19, further comprising zippers positioned around each protective flap for securing each protective flap to a sidewall of the structure.

* * * * *